US009206555B2

(12) United States Patent
Hermans et al.

(10) Patent No.: US 9,206,555 B2
(45) **Date of Patent: *Dec. 8, 2015**

(54) TISSUE HAVING HIGH STRENGTH AND LOW MODULUS

(71) Applicant: Kimberly-Clark Worldwide, Inc., Neenah, WI (US)

(72) Inventors: Michael Alan Hermans, Neenah, WI (US); Angela Ann Johnston, New London, WI (US); Gretchen Sarah Koch, Hortonville, WI (US); Maurizio Tirimacco, Appleton, WI (US); Erin Ann McCormick, Neenah, WI (US); Mark William Sachs, Appleton, WI (US); Jeffrey Dean Holz, Sherwood, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/702,002

(22) Filed: May 1, 2015

(65) Prior Publication Data

US 2015/0240426 A1 Aug. 27, 2015

Related U.S. Application Data

(63) Continuation-in-part of application No. 14/199,386, filed on Mar. 6, 2014, now Pat. No. 9,051,690, which is a continuation of application No. 13/755,516, filed on Jan. 31, 2013, now Pat. No. 8,702,905.

(51) Int. Cl.
*D21H 27/00* (2006.01)
*D21H 11/04* (2006.01)

(52) U.S. Cl.
CPC ..... *D21H 27/005* (2013.01); *D21H 11/04* (2013.01)

(58) Field of Classification Search
CPC ..... B23B 29/00; B23B 29/002; A47K 10/16; A47K 10/10; D21H 27/005; D21H 27/002; D21H 27/30; D21H 21/18; D21H 21/20; B31F 1/12
USPC ..... 162/109, 111–113, 117, 123; 428/152–153, 156, 172
See application file for complete search history.

(56) References Cited

U.S. PATENT DOCUMENTS

| | | | | |
|---|---|---|---|---|
| 4,440,597 | A | 4/1984 | Wells et al. | |
| 4,551,199 | A | 11/1985 | Weldon | |
| 4,849,054 | A | 7/1989 | Klowak | |
| 5,048,589 | A | 9/1991 | Cook et al. | |
| 5,137,600 | A | 8/1992 | Barnes et al. | |
| 5,383,778 | A | 1/1995 | Schulz | |
| 5,490,902 | A | 2/1996 | Schulz | |
| 5,607,551 | A | 3/1997 | Farrington, Jr. et al. | |
| 5,616,207 | A | 4/1997 | Sudall et al. | |
| 5,672,248 | A | 9/1997 | Wendt et al. | |
| 5,830,321 | A | 11/1998 | Lindsay et al. | |
| 5,888,347 | A | 3/1999 | Engel et al. | |
| 6,162,327 | A | 12/2000 | Batra et al. | |
| 6,187,137 | B1 | 2/2001 | Druecke et al. | |
| 6,197,154 | B1 | 3/2001 | Chen et al. | |
| 6,241,853 | B1 | 6/2001 | Smith et al. | |
| 6,461,474 | B1 | 10/2002 | Lindsay et al. | |
| 6,565,707 | B2 | 5/2003 | Behnke et al. | |
| 6,746,569 | B1 | 6/2004 | Wolkowicz et al. | |
| 6,808,790 | B2 | 10/2004 | Chen et al. | |
| 7,156,954 | B2 | 1/2007 | Farrington, Jr. et al. | |
| 7,160,418 | B2 | 1/2007 | Edwards et al. | |
| 7,749,355 | B2 | 7/2010 | Knobloch et al. | |
| 7,799,169 | B2 | 9/2010 | Bhat et al. | |
| 7,807,022 | B2 | 10/2010 | Hermans et al. | |
| 7,867,361 | B2 | 1/2011 | Salaam et al. | |
| 7,972,475 | B2 | 7/2011 | Chan et al. | |
| RE42,968 | E | 11/2011 | Sheehan et al. | |
| 8,070,913 | B2 | 12/2011 | Salaam et al. | |
| 8,187,419 | B2 | 5/2012 | Chan et al. | |
| 8,216,427 | B2 | 7/2012 | Klerelid et al. | |
| 8,257,551 | B2 | 9/2012 | Beuther et al. | |
| 8,273,446 | B2 | 9/2012 | Conner et al. | |
| 8,409,404 | B2 | 4/2013 | Harper et al. | |
| 8,481,133 | B2 | 7/2013 | Hermans et al. | |
| 8,574,399 | B2 * | 11/2013 | Hermans et al. | 162/109 |
| 8,652,597 | B2 | 2/2014 | Hermans et al. | |
| 8,702,905 | B1 * | 4/2014 | Hermans et al. | 162/109 |
| 8,753,751 | B1 * | 6/2014 | Hermans et al. | 428/532 |
| 8,834,677 | B2 * | 9/2014 | Tirimacco et al. | 162/109 |
| 8,956,503 | B2 * | 2/2015 | Hermans et al. | 162/109 |
| 9,051,690 | B2 * | 6/2015 | Hermans et al. | 1/1 |
| 2002/0099347 | A1 | 7/2002 | Chen et al. | |
| 2005/0136222 | A1 | 6/2005 | Hada et al. | |
| 2005/0161178 | A1 | 7/2005 | Hermans et al. | |
| 2005/0161179 | A1 | 7/2005 | Hermans et al. | |

(Continued)

FOREIGN PATENT DOCUMENTS

| | | |
|---|---|---|
| EP | 1 583 869 B1 | 2/2008 |
| EP | 2 013 416 B1 | 1/2011 |
| WO | WO 00/39393 A1 | 7/2000 |

OTHER PUBLICATIONS

Clayton J. Campbell, "Crepe Control Optimization to Improve Production Efficiency and Enhance Handfeel Softness," TAPPI Paper Summit, 2002, pp. 1-8.

*Primary Examiner* — Jose Fortuna
(74) *Attorney, Agent, or Firm* — Kimberly-Clark Worldwide, Inc.

(57) ABSTRACT

The present invention provides tissue products having a high degree of stretch and low modulus at relatively high tensile strengths, such as geometric mean tensile strengths greater than about 1500 g/3" and more preferably greater than about 2000 g/3". The combination of a tough, yet relatively supple sheet is preferably achieved by subjecting the embryonic web to a speed differential as it is passed from one fabric in the papermaking process to another, commonly referred to as rush transfer.

13 Claims, 4 Drawing Sheets

(56) References Cited

U.S. PATENT DOCUMENTS

| | | | | |
|---|---|---|---|---|
| 2006/0027349 | A1 | 2/2006 | Shannon et al. | |
| 2006/0065382 | A1 | 3/2006 | Burazin et al. | |
| 2006/0086472 | A1 | 4/2006 | Hermans et al. | |
| 2007/0051484 | A1 | 3/2007 | Hermans et al. | |
| 2007/0074834 | A1 | 4/2007 | Burazin et al. | |
| 2007/0137807 | A1 | 6/2007 | Schulz et al. | |
| 2007/0256802 | A1 | 11/2007 | Sheehan et al. | |
| 2007/0272380 | A1 | 11/2007 | Yeh et al. | |
| 2008/0000602 | A1 | 1/2008 | Dyer et al. | |
| 2008/0196849 | A1 | 8/2008 | Allen et al. | |
| 2009/0194244 | A1 | 8/2009 | Harper et al. | |
| 2009/0242154 | A1 | 10/2009 | Beuther et al. | |
| 2010/0051217 | A1 | 3/2010 | Allen et al. | |
| 2010/0051218 | A1 | 3/2010 | Allen et al. | |
| 2010/0078141 | A1 | 4/2010 | Hermans et al. | |
| 2010/0163197 | A1 | 7/2010 | Smits et al. | |
| 2010/0186913 | A1* | 7/2010 | Super et al. | 162/111 |
| 2010/0224338 | A1 | 9/2010 | Harper et al. | |
| 2010/0319863 | A1 | 12/2010 | Hermans et al. | |
| 2013/0068867 | A1 | 3/2013 | Hermans et al. | |
| 2013/0068868 | A1 | 3/2013 | Hermans et al. | |
| 2013/0071624 | A1 | 3/2013 | Manifold et al. | |
| 2013/0160960 | A1 | 6/2013 | Hermans et al. | |
| 2013/0269892 | A1* | 10/2013 | Hermans et al. | 162/111 |
| 2013/0327488 | A1* | 12/2013 | Super et al. | 162/111 |
| 2013/0327876 | A1 | 12/2013 | Wojcik et al. | |
| 2014/0027077 | A1* | 1/2014 | Hermans et al. | 162/111 |
| 2014/0050890 | A1 | 2/2014 | Zwick et al. | |
| 2014/0209262 | A1* | 7/2014 | Hermans et al. | 162/100 |
| 2014/0209264 | A1* | 7/2014 | Tirimacco et al. | 162/164.3 |
| 2014/0209265 | A1* | 7/2014 | Hermans et al. | 162/231 |

* cited by examiner

TISSUE HAVING HIGH STRENGTH AND LOW MODULUS

RELATED APPLICATIONS

The present application is a continuation-in-part applications and claims priority to U.S. patent application Ser. No. 14/199,386, filed on Mar. 6, 2014, now U.S. Pat. No. 9,051,690, which is a continuation application of and claims priority to U.S. patent application Ser. No. 13/755,516, filed on Jan. 31, 2013, now U.S. Pat. No. 8,702,905, all of which are incorporated herein by reference.

BACKGROUND

In the field of tissue products, such as facial tissue, bath tissue, table napkins, paper towels and the like, the machine direction (MD) properties are of particular importance for producing a product that is sufficiently strong to withstand use, but soft and flexible enough to be pleasing to the user. The MD properties which contribute most significantly to the performance of a tissue sheet are MD stretch and modulus, as increasing stretch and decreasing the modulus at a given tensile strength will generally increase the durability and reduce the stiffness of the tissue product. Increasing MD stretch and decreasing modulus not only improves the hand feel of the tissue product in-use, it may also improve the manufacturing efficiency of tissue products, particularly the efficiency of converting operations, which would benefit from increases in durability. Thus, it may be desirable to increase the amount of MD stretch while decreasing the MD modulus over that which is obtained by conventional methods and found in conventional sheets. For example, a creped tissue may have an MD Slope of about 20 to about 30 kg. These levels of MD Slope have been decreased in through-air dried uncreped tissues, such as those disclosed in commonly assigned U.S. Pat. No. 5,607,551, to less than about 10 kg. However, these reduced MD Slopes are typically observed only in products having geometric mean tensile strengths (GMT) less than about 1000 g/3". Accordingly, there remains a need for tissue products having relatively high GMT, yet low MD Slopes.

SUMMARY

It has now been surprisingly discovered that levels of MD Stretch may be increased and MD Slope may be decreased by manufacturing a tissue sheet using a process in which the embryonic web is subjected to a high degree of rush transfer, even when the GMT of the web is greater than about 1500 g/3", such as from about 1500 to about 3500 g/3". The term "rush transfer" generally refers to the process of subjecting the embryonic web to differing speeds as it is transferred from one fabric in the papermaking process to another. The present invention provides a process in which the embryonic web is subjected to a high degree of rush transfer when the web is transferred from the forming fabric to the transfer fabric, i.e., the "first position." The overall speed differential between the forming fabric and the transfer fabric may be, for example, from about 30 to about 70 percent, more preferably from about 50 to about 60 percent.

Accordingly, in certain embodiments the present invention offers an improvement in papermaking methods and products, by providing a tissue sheet and a method to obtain a tissue sheet, with improved MD Stretch and reduced MD Slope at a given tensile strength. Thus, by way of example, the present invention provides a tissue sheet having a basis weight greater than about 30 grams per square meter (gsm), an MD Slope less than about 5 kg and a GMT greater than about 1500 g/3". The decrease in MD Slope improves the hand feel of the tissue sheet, while also reducing the tendency of a sheet to tear in the machine direction in use.

In other embodiments the present invention provides a tissue MD TEA (expressed as g*cm/cm$^2$) equal to or greater than about:

$$0.03234(\text{GMT})-27.452$$

wherein GMT is the geometric mean tensile expressed in grams per three inches and the GMT is from about 2200 to about 3500 g/3".

In other embodiments the present invention provides a tissue product having a GM Slope (expressed as kilograms per three inches) less than or equal to about:

$$0.0042*\text{GMT}-0.5286$$

wherein GMT is the Geometric Mean Tensile (expressed as grams per three inches) and the GMT is from about 1500 g/3" to about 3500 g/3".

In another embodiment the present invention provides a tissue product comprising one or more tissue plies, at least one tissue ply having a basis weight greater than about 30 gsm, an MD Slope less than about 5 kg and a GMT greater than about 1500 g/3".

In yet other embodiments the present invention provides a multi-ply through-air dried tissue product having a bone dry basis weight from about 40 to about 60 gsm, a GMT greater than about 2000 g/3" and a GM Slope less than about 10 kg.

In other embodiments the present invention provides a single ply through-air dried tissue product having a bone dry basis weight greater than about 40 gsm, an MD Slope less than about 5 kg and a GMT greater than about 2000 g/3".

In still other embodiments the present invention provides a tissue web having a bone dry basis weight greater than about 30 gsm, an MD Slope less than about 5 kg, a GM TEA greater than about 40 g*cm/cm$^2$ and a GMT greater than about 2000 g/3".

In yet other embodiments the present invention provides rolled tissue product comprising a tissue web spirally wound into a roll, the tissue web having a GM Slope less than about 10 kg and a GMT from about 2000 to about 3250 g/3", the product having a Roll Firmness of less than about 7 mm.

DEFINITIONS

Figure 1:
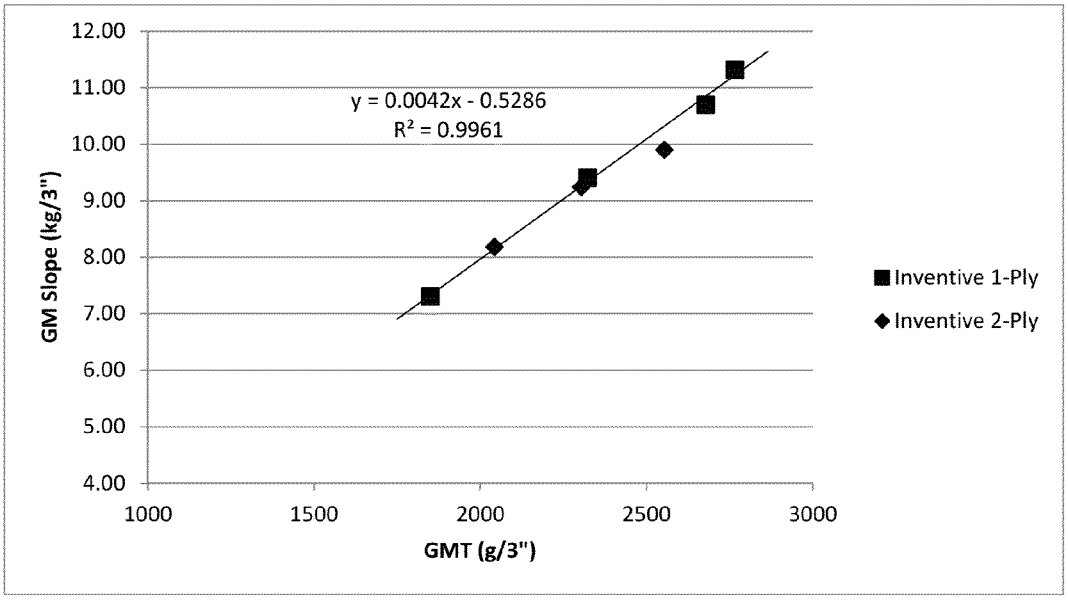
FIG. 1 is a graph plotting GMT (x-axis) versus GM Slope (y-axis) for inventive tissue products and illustrates the linear relationship achieved between the two properties.
Figure 2:
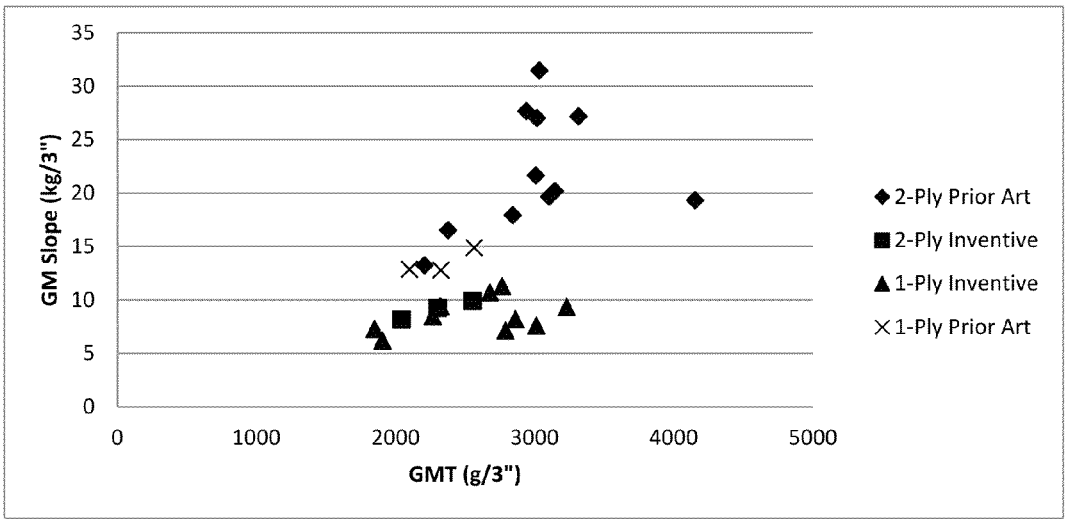
FIG. 2 is a graph plotting GMT (x-axis) versus GM Slope (y-axis) for prior art and inventive tissue products.
Figure 3:
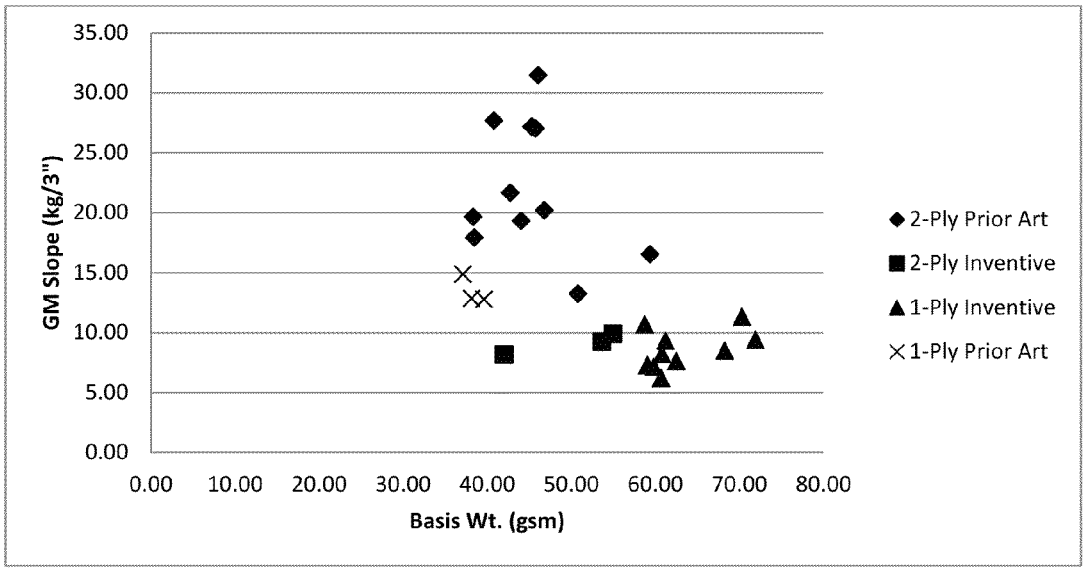
FIG. 3 is a graph plotting bone dry basis weight (x-axis) versus GM Slope (y-axis) for prior art and inventive tissue products.
Figure 4:
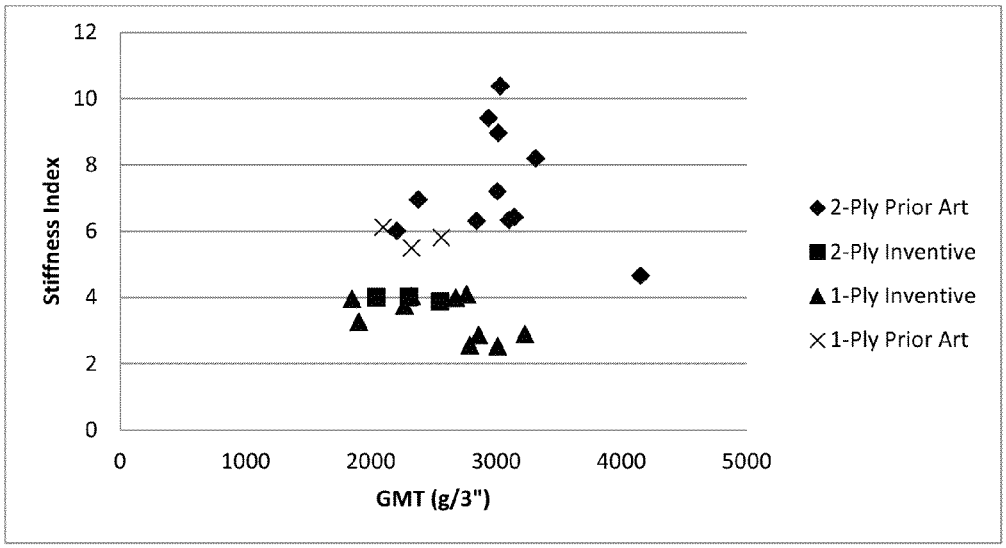
FIG. 4 is a graph plotting GMT (x-axis) versus Stiffness Index (y-axis) for prior art and inventive tissue products.
Figure 5:
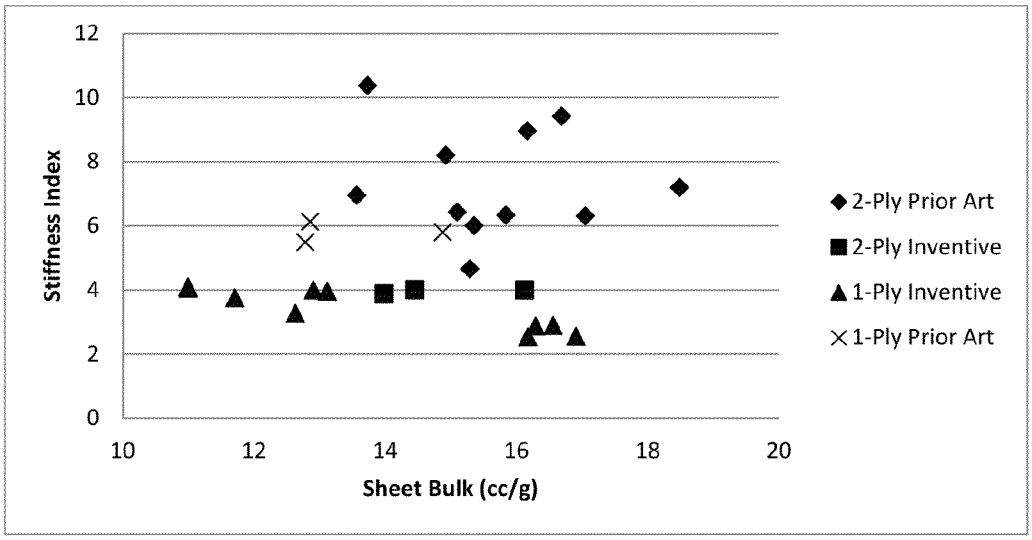
FIG. 5 is a graph plotting Sheet Bulk (x-axis) versus Stiffness Index (y-axis) for prior art and inventive tissue products.

As used herein, the term "tissue product" refers to products made from tissue webs and includes, bath tissues, facial tissues, paper towels, industrial wipers, foodservice wipers, napkins, medical pads, and other similar products. Tissue products may comprise one, two, three or more plies.

As used herein, the terms "tissue web" and "tissue sheet" refer to a fibrous sheet material suitable for forming a tissue product.

As used herein, the term "caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "basis weight" generally refers to the bone dry weight per unit area of a tissue and is generally expressed as grams per square meter (gsm). Basis weight is measured using TAPPI test method T-220.

As used herein, the term "Sheet Bulk" refers to the quotient of the caliper (μm) divided by the bone dry basis weight (gsm). The resulting Sheet Bulk is expressed in cubic centimeters per gram (cc/g).

As used herein, the term "Geometric Mean Tensile" (GMT) refers to the square root of the product of the machine direction tensile and the cross-machine direction tensile of the web, which are determined as described in the Test Method section.

As used herein, the term "Tensile Energy Absorption" (TEA) refers to the area under the stress-strain curve during the tensile test described in the Test Methods section below. Since the thickness of a paper sheet is generally unknown and varies during the test, it is common practice to ignore the cross-sectional area of the sheet and report the "stress" on the sheet as a load per unit length or typically in the units of grams per 3 inches of width. For the TEA calculation, the stress is converted to grams per centimeter and the area calculated by integration. The units of strain are centimeters per centimeter so that the final TEA units become g-cm/cm$^2$. Separate TEA values are reported for the MD and CD directions. Further, the term "GM TEA" refers to the square root of the product of the MD TEA and the CD TEA of the web.

As used herein, the term "Stretch" generally refers to the ratio of the slack-corrected elongation of a specimen at the point it generates its peak load divided by the slack-corrected gauge length in any given orientation. Stretch is an output of the MTS TestWorks™ in the course of determining the tensile strength as described in the Test Methods section herein. Stretch is reported as a percentage and may be reported for machine direction stretch (MDS), cross machine direction stretch (CDS) or geometric mean stretch (GMS).

As used herein, the term "Slope" refers to slope of the line resulting from plotting tensile versus stretch and is an output of the MTS TestWorks™ in the course of determining the tensile strength as described in the Test Methods section herein. Slope is reported in the units of kilograms (kg) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms per three inches.

As used herein, the term "Geometric Mean Slope" (GM Slope) generally refers to the square root of the product of machine direction slope and cross-machine direction slope.

As used herein, the term "Stiffness Index" refers to the quotient of the Geometric Mean Slope (having units of g/3") divided by the Geometric Mean Tensile strength (having units of g/3").

As used herein, the term "roll bulk" refers to the volume of paper divided by its mass on the wound roll. Roll bulk is calculated by multiplying pi (3.142) by the quantity obtained by calculating the difference of the roll diameter squared (cm$^2$) and the outer core diameter squared (cm$^2$) divided by 4, divided by the quantity sheet length (cm) multiplied by the sheet count multiplied by the bone dry basis weight of the sheet in grams per square meter (gsm).

DETAILED DESCRIPTION

The instant tissue products and webs have a high degree of stretch and low modulus at relatively high tensile strengths, such as geometric mean tensile strengths greater than about 1500 g/3" and more preferably greater than about 2000 g/3". The combination of a tough, yet relatively supple sheet is preferably achieved by subjecting the embryonic web to a speed differential as it is passed from one fabric in the papermaking process to another, commonly referred to as rush transfer. Rush transfer is preferably performed when the web is transferred from the forming fabric to the transfer fabric. Speed differentials between the forming fabric and the transfer fabric are generally from about 30 to about 70 percent and more preferably from about 50 to about 60 percent.

Generally as the degree of rush transfer is increased the MD Stretch is increased, however, the structural change in the sheet resulting from the imposed speed differential enables MD modulus to be reduced independent of MD tensile. The structural change is best described as extensive microfolding in a sheet arising from the imposed mass balance requirements at the point of sheet transfer. The resulting web further has improved GM TEA, MD Slope, and MD Stretch compared to webs and products made according to the prior art. These improved properties are achieved without a decrease in GMT compared to prior art tissue products. These improvements translate into improved tissue products, as summarized in Table 1, below.

TABLE 1

| Product | Plies | MD Stretch (%) | MD Slope (kg/3") | GM Slope (kg/3") | MD TEA (g * cm/cm$^2$) | GMT (g/3") |
|---|---|---|---|---|---|---|
| Bounty ™ Basic | 1 | 13.9 | 10.6 | 12.9 | 28.6 | 2099 |
| Scott ™ Towels | 1 | 15.8 | 22.3 | 14.86 | 33.5 | 2564 |
| Scott ™ Naturals | 1 | 14.1 | 29.1 | 13.75 | 29.1 | 2326 |
| Inventive | 1 | 55.9 | 4.3 | 8.2 | 86.5 | 2860 |

The methods of manufacture set forth herein are particularly well suited for the manufacture of tissue products and more particularly towel products having bone dry basis weight greater than about 35 gsm, such as from about 35 to about 70 gsm and more preferably from about 45 to about 60 gsm. Accordingly, in certain embodiments, rolled products made according to the present invention may comprise a spirally wound single-ply or multi-ply (such as two, three or four plies) tissue web having a bone dry basis weight greater than about 35 gsm, such as from about 35 to about 70 gsm and more preferably from about 45 to about 60 gsm. Generally, when referred to herein, the basis weight is the bone dry basis weight in grams per square meter.

While having improved properties, the tissue webs prepared according to the present invention continue to be strong enough to withstand use by a consumer. For example, tissue webs prepared according to the present invention may have a geometric mean tensile (GMT) greater than about 1500 g/3", such as from about 1500 to about 3500 g/3", and more preferably from about 2000 to about 2500 g/3". When the tissue webs of the present invention are converted into rolled tissue products, they maintain a significant amount of their tensile strength, such that the decrease in geometric mean tensile during conversion of the web to finished product is less than about 30 percent and still more preferably less than about 25 percent, such as from about 10 to about 30 percent. As such the finished products preferably have a geometric mean tensile strength of greater than 1500 g/3", such as from about 1750 to about 3000 g/3", and more preferably from about 2500 to about 2750 g/3".

Not only are the tissue webs of the present invention strong enough to withstand use, but they are not overly stiff. Accordingly, in certain embodiments tissue webs prepared as described herein have a GMT greater than about 1500 g/3", such as from about 1800 to about 3500 g/3" and more preferably from about 2000 to about 3000 g/3", while having MD Slopes less than about 10 kg and more preferably less than about 7.5 kg, such as from about 3 to about 5 kg. In one particular embodiment, for instance, the disclosure provides a rolled tissue product comprising a spirally wound single ply tissue web having a basis weight from about 40 to about 60 gsm, GMT greater than about 1500 g/3" and a MD Slope less than about 7.5 kg.

In addition to having reduced MD Slopes, the products of the present invention also have relatively high CD stretch and relatively low CD Slopes. Therefore, products of the present invention generally have reduced geometric mean slopes (GM Slope), particularly given the relatively high tensile strengths. Accordingly, in certain embodiments, tissue sheets and products prepared as described herein generally have a geometric mean slope less than about 10 kg, such as from about 3 to about 10 kg and more preferably from about 4 to about 7.5 kg. While the tissue sheets of the present invention generally have lower geometric mean slopes compared to sheets of the prior art, the sheets maintain a sufficient amount of tensile strength to remain useful to the consumer. In this manner the disclosure provides tissue sheets and products having a low Stiffness Index. For example, tissue sheets preferably have a Stiffness Index less than about 5.0, such as from about 2.0 to about 5.0 and more preferably from about 3.0 to about 4.0. In a particularly preferred embodiment the present invention provides a single ply tissue web having a bone dry basis weight greater than about 45 gsm, a Stiffness Index less than about 5.0 and a GMT from about 1500 to about 3000 g/3".

Accordingly, in a particularly preferred embodiment the present invention provides a tissue product wherein the GM Slope is linearly related to the GMT by equation (1), below:

$$\text{GM Slope} \leq 0.0042*\text{GMT} - 0.5286 \quad \text{(Equation 1)}$$

The linear relationship is illustrated in FIG. 1. In other embodiments, the present invention provides a tissue product wherein the GM Slope (expressed as kilograms per three inches) is less than or equal to about 0.0042*GMT−0.5286, wherein GMT is the Geometric Mean Tensile in grams per three inches and the GMT is from about 1500 to about 3000 g/3".

In still other embodiments, the present invention provides tissue webs having enhanced bulk and durability and decreased stiffness. Improved durability may be measured as increased machine and cross-machine direction stretch (MDS and CDS) or as increased MD TEA, while reduced stiffness may be measured as a reduction in the slope of the tensile-strain curve or the Stiffness Index. For example, spirally wound products preferably have a geometric mean stretch (GMS) greater than about 15, such as from about 15 to about 25 and more preferably from about 18 to about 22.

Figure 7:
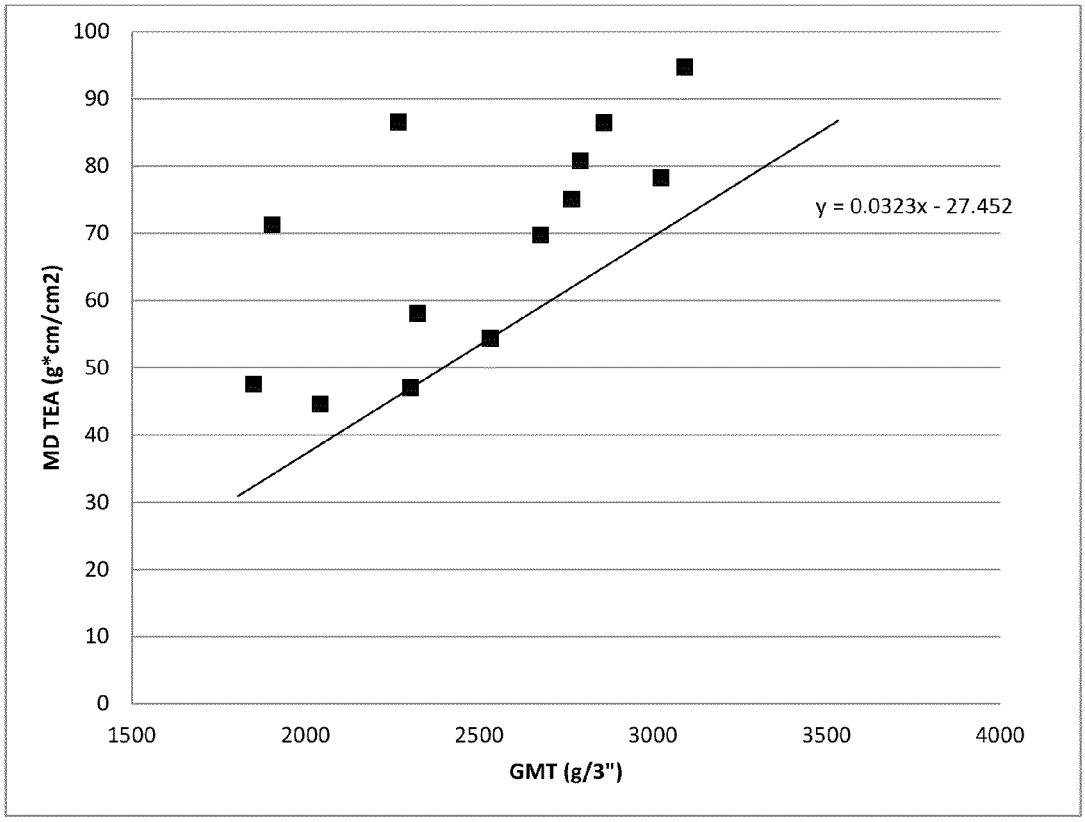
FIG. 7 is a graph plotting GMT (x-axis) versus GM TEA (y-axis) for inventive tissue products.

In other embodiments tissue products have a MD TEA greater than about 40 g*cm/cm$^2$, such as from about 40 to about 100 g*cm/cm$^2$, and more preferably from about 70 to about 90 g*cm/cm$^2$. The foregoing MD TEA values are generally achieved at GMT greater than about 1500 g/3", such as from about 1800 to about 3500 g/3" and more preferably from about 2000 to about 3000 g/3". The relationship of MD TEA and GMT achieved in the present inventive tissue products if further illustrated in FIG. 7. Plotting a line through the sample Rolls 11 and 12, prepared as described below, yields a relationship between GMT and MD TEA such that for all of the inventive samples MD TEA (expressed in g*cm/cm2) is equal to or greater than: 0.03234(GMT)−27.452, where GMT is the Geometric Mean Tensile in grams per three inches.

In addition to having relatively low modulus and high MD TEA at a given tensile strength, the tissue sheets and products of the present invention have improved caliper and bulk as illustrated in Table 2, below. Accordingly, it has now been discovered that tissue products having a GMT from about 2000 to about 3000 g/3" and a GM Slope from about 3 to about 5 kg may be produced such that the product has a Sheet Bulk greater than about 15 cc/g, such as from about 15 to about 20 cc/g, and more preferably from about 16 to about 18 cc/g.

TABLE 2

| | Plies | GMT | GM Slope (kg/3") | BW (gsm) | Caliper (um) | Sheet Bulk (cc/g) | Stiffness Index |
|---|---|---|---|---|---|---|---|
| Bounty ™ Basic | 1 | 2099 | 12.9 | 38.1 | 683.3 | 17.9 | 6.1 |
| Scott ™ Towels | 1 | 2564 | 14.86 | 37.1 | 650.2 | 17.5 | 5.8 |
| Scott ™ Naturals | 1 | 2326 | 13.75 | 39.6 | 769.6 | 19.4 | 5.8 |
| Inventive | 1 | 2860 | 8.2 | 60.8 | 990.6 | 16.3 | 2.8 |

As noted previously, webs prepared as described herein may be converted into either single or multi-ply rolled tissue products that have improved properties over the prior art. Table 3 below compares certain inventive multi-ply tissue products with commercially available multi-ply products. As illustrated in Table 3 the inventive multi-ply tissue products generally have improved properties compared to commercially available multi-ply products, such as lower GM Slope and higher MD TEA at a given tensile strength. Accordingly, in one embodiment the present invention provides a rolled tissue product comprising a spirally wound multi-ply tissue web, wherein the tissue web has a GMT greater than about 1500 g/3" and an MD Slope less than about 10 kg and more preferably less than about 8 kg. In other embodiments the disclosure provides a spirally wound multi-ply tissue sheet having a basis weight greater than about 45 gsm and a Stiffness Index less than about 5.0 and more preferably less than about 4.0.

TABLE 3

| Product | Plies | MD Stretch (%) | MD Slope (kg/3") | GM Slope (kg/3") | MD TEA (g * cm/cm$^2$) | GMT (g/3") | Stiffness Index |
|---|---|---|---|---|---|---|---|
| Brawny ™ | 2 | 20.2 | 8.2 | 13.3 | 33.0 | 2207 | 6.03 |
| Bounty ™ | 2 | 13.9 | 19.4 | 21.7 | 38.9 | 3009 | 7.21 |
| Sparkle ™ | 2 | 17.5 | 17.2 | 27.2 | 47.5 | 3315 | 8.21 |
| Inventive | 2 | 24.4 | 9.7 | 9.2 | 47.0 | 2304 | 3.99 |

Webs useful in preparing spirally wound tissue products according to the present invention can vary depending upon the particular application. In general, the webs can be made from any suitable type of fiber. For instance, the base web can be made from pulp fibers, other natural fibers, synthetic fibers, and the like. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish.

Tissue webs made in accordance with the present invention can be made with a homogeneous fiber furnish or can be formed from a stratified fiber furnish producing layers within the single- or multi-ply product. Stratified base webs can be formed using equipment known in the art, such as a multi-layered headbox. Both strength and softness of the base web can be adjusted as desired through layered tissues, such as those produced from stratified headboxes.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present invention includes a first outer layer and a second outer layer containing primarily hardwood fibers. The hardwood fibers can be mixed, if desired, with paper broke in an amount up to about 10 percent by weight and/or softwood fibers in an amount up to about 10 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™) Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue products of the present invention can generally be formed by any of a variety of papermaking processes known in the art. Preferably the tissue web is formed by through-air drying and be either creped or uncreped. For example, a papermaking process of the present invention can utilize adhesive creping, wet creping, double creping, embossing, wet-pressing, air pressing, through-air drying, creped through-air drying, uncreped through-air drying, as well as other steps in forming the paper web. Some examples of such techniques are disclosed in U.S. Pat. Nos. 5,048,589, 5,399,412, 5,129,988 and 5,494,554 all of which are incorporated herein in a manner consistent with the present invention. When forming multi-ply tissue products, the separate plies can be made from the same process or from different processes as desired.

Preferably the base web is formed by an uncreped through-air drying process, such as the process described, for example, in U.S. Pat. Nos. 5,656,132 and 6,017,417, both of which are hereby incorporated by reference herein in a manner consistent with the present invention.

In one embodiment the web is formed using a twin wire former having a papermaking headbox that injects or deposits a furnish of an aqueous suspension of papermaking fibers onto a plurality of forming fabrics, such as the outer forming fabric and the inner forming fabric, thereby forming a wet tissue web. The forming process of the present invention may be any conventional forming process known in the papermaking industry. Such formation processes include, but are not limited to, Fourdriniers, roof formers such as suction breast roll formers, and gap formers such as twin wire formers and crescent formers.

The wet tissue web forms on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fibers. Additional dewatering of the wet tissue web may be carried out by known paper making techniques, such as vacuum suction boxes, while the inner forming fabric supports the wet tissue web. The wet tissue web may be additionally dewatered to a consistency of greater than 20 percent, more specifically between about 20 to about 40 percent, and more specifically about 20 to about 30 percent.

The forming fabric can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.).

The wet web is then transferred from the forming fabric to a transfer fabric while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric may be carried out with the assistance of positive and/or negative pressure. For example, in one embodiment, a vacuum shoe can apply negative pressure such that the forming fabric and the transfer fabric simultaneously converge and diverge at the leading edge of the vacuum slot. Typically, the vacuum shoe supplies pressure at levels between about 10 to about 25 inches of mercury. As stated above, the vacuum transfer shoe (negative pressure) can be supplemented or replaced by the use of positive pressure from the opposite side of the web to blow the web onto the next fabric. In some embodiments, other vacuum shoes can also be used to assist in drawing the fibrous web onto the surface of the transfer fabric.

Typically, the transfer fabric travels at a slower speed than the forming fabric to enhance the MD and CD stretch of the web, which generally refers to the stretch of a web in its cross (CD) or machine direction (MD) (expressed as percent elongation at sample failure). For example, the relative speed difference between the two fabrics can be from about 30 to about 70 percent and more preferably from about 40 to about 60 percent. This is commonly referred to as "rush transfer". During rush transfer many of the bonds of the web are believed to be broken, thereby forcing the sheet to bend and fold into the depressions on the surface of the transfer fabric. Such molding to the contours of the surface of the transfer fabric may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present invention.

The wet tissue web is then transferred from the transfer fabric to a through-air drying fabric. Typically, the transfer fabric travels at approximately the same speed as the through-air drying fabric. However, a second rush transfer may be performed as the web is transferred from the transfer fabric to the through-air drying fabric. This rush transfer is referred to as occurring at the second position and is achieved by operating the through-air drying fabric at a slower speed than the transfer fabric.

In addition to rush transferring the wet tissue web from the transfer fabric to the through-air drying fabric, the wet tissue web may be macroscopically rearranged to conform to the surface of the through-air drying fabric with the aid of a vacuum transfer roll or a vacuum transfer shoe. If desired, the through-air drying fabric can be run at a speed slower than the speed of the transfer fabric to further enhance MD stretch of the resulting absorbent tissue product. The transfer may be carried out with vacuum assistance to ensure conformation of the wet tissue web to the topography of the through-air drying fabric.

While supported by a through-air drying fabric, the wet tissue web is dried to a final consistency of about 94 percent or greater by a through-air dryer. The web then passes through the winding nip between the reel drum and the reel and is wound into a roll of tissue for subsequent converting.

The following examples are intended to illustrate particular embodiments of the present invention without limiting the scope of the appended claims.

Test Methods

Tensile

Samples for tensile strength testing are prepared by cutting a 3" (76.2 mm)×5" (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches (50.8±1 mm). The jaws are operated using pneumatic-action and are rubber coated. The minimum grip face width is 3" (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

In addition to tensile strength, the stretch, tensile energy absorbed (TEA), and slope are also reported by the MTS TestWorks™ program for each sample measured. Stretch (either MD stretch or CD stretch) is reported as a percentage and is defined as the ratio of the slack-corrected elongation of a specimen at the point it generates its peak load divided by the slack-corrected gauge length. Slope is reported in the units of grams (g) and is defined as the gradient of the least-squares line fitted to the load-corrected strain points falling between a specimen-generated force of 70 to 157 grams (0.687 to 1.540 N) divided by the specimen width.

Total energy absorbed (TEA) is calculated as the area under the stress-strain curve during the same tensile test as has previously been described above. The area is based on the strain value reached when the sheet is strained to rupture and the load placed on the sheet has dropped to 65 percent of the peak tensile load. For the TEA calculation, the stress is converted to grams per centimeter and the area calculated by integration. The units of strain are centimeters per centimeter so that the final TEA units become g*cm/cm$^2$.

Roll Firmness

Roll Firmness was measured using the Kershaw Test as described in detail in U.S. Pat. No. 6,077,590, which is incorporated herein by reference in a manner consistent with the present invention. The apparatus is available from Kershaw Instrumentation, Inc. (Swedesboro, N.J.) and is known as a Model RDT-2002 Roll Density Tester.

EXAMPLES

Example 1

Single-Ply Towel

Base sheets were made using a through-air dried papermaking process commonly referred to as "uncreped through-air dried" ("UCTAD") and generally described in U.S. Pat. No. 5,607,551, the contents of which are incorporated herein in a manner consistent with the present invention. Base sheets with a target bone dry basis weight of about 64 grams per square meter (gsm) were produced. The base sheets were then converted and spirally wound into rolled tissue products.

In all cases the base sheets were produced from a furnish comprising northern softwood kraft and eucalyptus kraft using a layered headbox fed by three stock chests such that the webs having three layers (two outer layers and a middle layer) were formed. The two outer layers were comprised of 50% eucalyptus (EUC) and 50% Northern Softwood Kraft (NSWK) (each layer comprising 30 percent weight by total weight of the web; by weight each outer layer is 15% eucalyptus weight by total weight of the web and 15% NSWK weight by total weight of the web). The middle layer comprised eucalyptus and/or NSWK and is 40% weight by total weight of the web. The amount of NSWK and eucalyptus in the middle layer for each inventive sample is shown in Table 4 as a percent of the middle layer (the middle layer is 40% weight by total weight of the web). Strength was controlled via the addition of CMC, Kymene and/or by refining the NSWK furnish of both the outer and center layers as set forth in Table 4, below.

The tissue web was formed on a Voith Fabrics TissueForm V forming fabric, vacuum dewatered to approximately 25 percent consistency and then subjected to rush transfer when transferred to the transfer fabric. The degree of rush transfer varied by sample, as set forth in Table 4, below. The transfer fabric was the fabric described as t1207-11 (commercially available from Voith Fabrics, Appleton, Wis.).

The web was then transferred to a through-air drying fabric. The through-air drying fabric varied by sample, as set forth in Table 4, below. Transfer to the through-drying fabric was done using vacuum levels of greater than 10 inches of mercury at the transfer. The web was then dried to approximately 98 percent solids before winding.

Table 4 shows the process conditions for each of the samples prepared in accordance with the present example. Table 5 summarizes the physical properties of the base sheet webs.

TABLE 4

| Sample | Center Layer Furnish | Refining of NSWK (hp-day per MT) | Kymene (kg/MT) | CMC (kg/MT) | TAD Fabric | Rush Transfer (%) |
|---|---|---|---|---|---|---|
| 1 | 50% EUC<br>50% NSWK | 0 | 6.0 | 1.7 | t603-1 | 60 |
| 2 | 50% EUC<br>50% NSWK | 0 | 6.0 | 2.0 | t2403-9 | 60 |
| 3 | 100% NSWK | 1.2 | 8.0 | 2.7 | t603-1 | 60 |
| 4 | 100% NSWK | 1.4 | 6.0 | 2.0 | t603-1 | 50 |

TABLE 5

| Sample | Base Sheet BW (gsm) | Base Sheet GMT (g/3") | Base Sheet Caliper (μm) | Base Sheet Bulk (cc/g) | Base Sheet GM Slope (kg) | Base Sheet Stiffness Index |
|---|---|---|---|---|---|---|
| 1 | 64.1 | 3627 | 1272.5 | 19.9 | 13.4 | 3.7 |
| 2 | 63.3 | 3625 | 1310.6 | 20.7 | 13.5 | 3.7 |
| 3 | 64.3 | 3543 | 1333.5 | 20.7 | 15.5 | 4.4 |
| 4 | 64.2 | 3572 | 1316.5 | 20.5 | 15.4 | 4.3 |

The base sheet webs were converted into various rolled towels. Specifically, base sheet was calendered using one conventional polyurethane/steel calender comprising a 40 P&J polyurethane roll on the air side of the sheet and a standard steel roll on the fabric side. Process conditions for each sample are provided in Table 6 and the resulting product properties are summarized in Table 7, below. All rolled products comprised a single ply of base sheet, such that rolled product sample Roll 1 comprised a single ply of base sheet sample 1, Roll 2 comprised a single ply of base sheet sample 2, and so forth.

TABLE 6

| Sample | 40 P&J Calender Load (pli) | Product Basis Weight (gsm) | Product Sheet Caliper (μm) | Product Sheet Bulk (cc/g) | Roll Diameter (mm) | Roll Firmness (mm) | Roll Bulk (cc/g) |
|---|---|---|---|---|---|---|---|
| Roll 1 | 60 | 60.8 | 990.6 | 16.3 | 137 | 6.4 | 13.23 |
| Roll 2 | 60 | 59.8 | 1010.9 | 16.9 | 136 | 6.8 | 13.68 |
| Roll 3 | 60 | 62.5 | 1010.9 | 16.2 | 134 | 6.3 | 12.69 |
| Roll 4 | 60 | 61.2 | 1013.5 | 16.6 | 134 | 6.8 | 13.19 |

TABLE 7

| Sample | Product GMT (g/3") | Product MD Stretch (%) | Product MD Slope (kg/3") | Product GM Slope (kg/3") | Product MD TEA (g * cm/cm$^2$) | Product Stiffness Index |
|---|---|---|---|---|---|---|
| Roll 1 | 2860 | 55.9 | 4.3 | 8.2 | 86.5 | 2.9 |
| Roll 2 | 2791 | 55.0 | 3.5 | 7.1 | 80.8 | 2.6 |
| Roll 3 | 3092 | 56.7 | 4.7 | 8.0 | 94.8 | 2.6 |
| Roll 4 | 3024 | 45.1 | 5.0 | 8.2 | 78.3 | 2.7 |

Example 2

Single-Ply Towel

Figure 6:
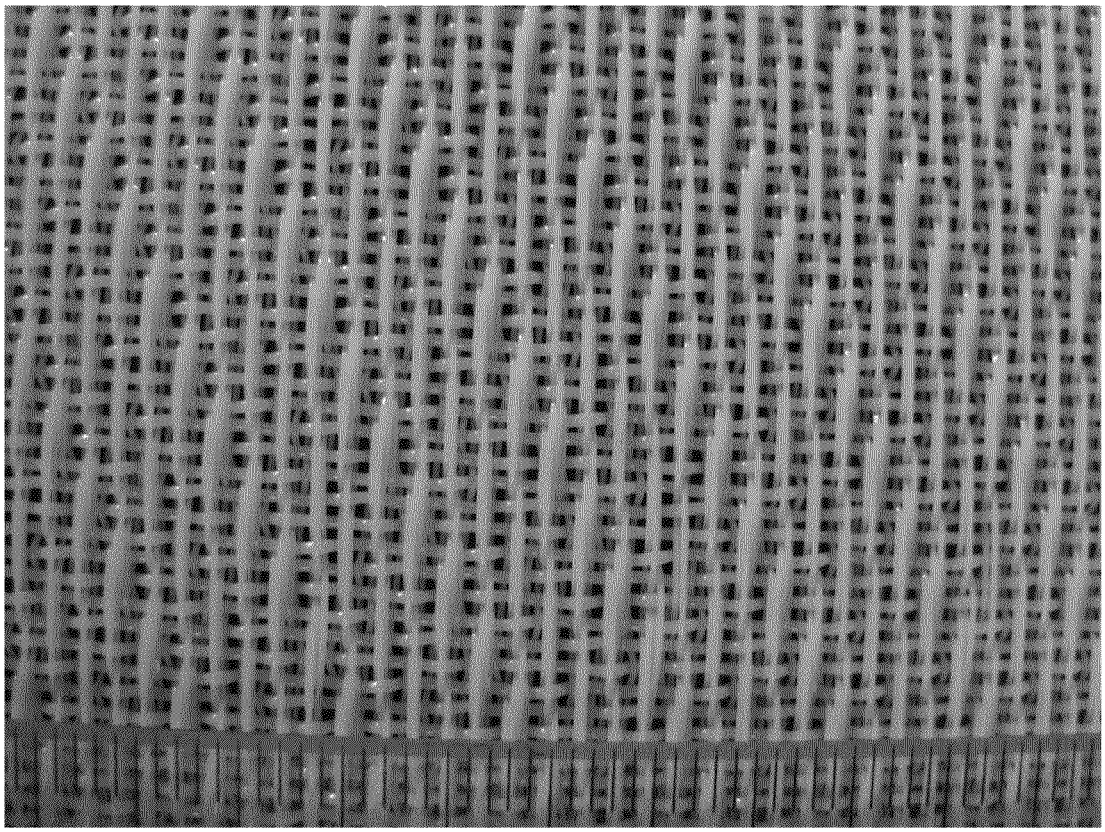
FIG. 6 is a photograph of a through-air drying fabric, referred to herein as T2407-13, useful in producing the inventive tissue disclosed herein.

Base sheets were prepared substantially as described in Example 1 with certain manufacturing parameters adjusted as described in Table 8, below. The TAD Fabric t2403-9 is illustrated in FIG. 6.

TABLE 8

| Sample | Layer Split (Wt. % Air/Middle/Felt) | Refining (hpt/day) | TAD Fabric | Rush Transfer (%) | Base Sheet Basis Weight (gsm) | Base Sheet GMT (g/3") |
|---|---|---|---|---|---|---|
| 5 | 30 EUC/40 NSWK/30 EUC | In loop | T2407-13 | 60 | 70.8 | 2811 |
| 6 | 30 EUC/40 NSWK/30 EUC | In loop | T2407-13 | 60 | 61.8 | 2463 |
| 7 | 30 EUC/40 NSWK/30 EUC | 0 | T2407-13 | 40 | 73.2 | 2998 |
| 8 | 30 EUC/40 NSWK/30 EUC | In loop | T2407-13 | 40 | 72.3 | 3442 |
| 9 | 30 EUC/40 NSWK/30 EUC | 1.3 | T2407-13 | 40 | 59.6 | 30.82 |
| 10 | 30 EUC/40 NSWK/30 EUC | 0 | T2407-13 | 40 | 61.1 | 2344 |

The base sheet webs were converted into various rolled towels. Specifically, base sheet was calendered using one or two conventional polyurethane/steel calenders comprising a 4 P&J polyurethane roll on the air side of the sheet and a standard steel roll on the fabric side. Process conditions for each sample are provided in Table 9 and the resulting product properties are summarized in Table 10, below. All rolled products comprised a single ply of base sheet, such that rolled product sample Roll 5 comprised a single ply of base sheet sample 5, Roll 6 comprised a single ply of base sheet sample 6, and so forth.

TABLE 9

| Sample | 4 P&J Calender Load (pli) | Product Basis Weight (gsm) | Product Sheet Caliper (μm) | Product Sheet Bulk (cc/g) | Roll Bulk (cc/g) | Roll Firmness (mm) |
|---|---|---|---|---|---|---|
| Roll 5 | 30 | 68.3 | 799.1 | 11.71 | 10.88 | 6.7 |
| Roll 6 | 30 | 60.7 | 766.6 | 12.63 | 12.51 | 4.4 |
| Roll 7 | 30 | 71.9 | 791.0 | 11.00 | 10.33 | 7.1 |
| Roll 8 | 30 | 70.3 | 773.2 | 10.99 | 10.45 | 8.7 |
| Roll 9 | 20 | 58.7 | 757.9 | 12.91 | 12.47 | 10.4 |
| Roll 10 | 20 | 59.1 | 774.7 | 13.12 | 12.35 | 8.7 |

TABLE 10

| Sample | Product GMT (g/3") | Product MD Stretch (%) | Product MD Slope (kg/3") | Product GM Slope (kg/3") | Product MD TEA (g * cm/cm$^2$) | Product Stiffness Index |
|---|---|---|---|---|---|---|
| Roll 5 | 2269 | 60.0 | 4.5 | 8.50 | 86.6 | 3.75 |
| Roll 6 | 1904 | 59.3 | 3.5 | 6.21 | 71.3 | 3.26 |
| Roll 7 | 2323 | 34.6 | 6.1 | 9.41 | 58.1 | 4.05 |
| Roll 8 | 2766 | 35.8 | 7.3 | 11.32 | 75.1 | 4.09 |
| Roll 9 | 2678 | 35.8 | 7.3 | 10.70 | 69.7 | 4.00 |
| Roll 10 | 1850 | 34.2 | 5.2 | 7.31 | 47.6 | 3.95 |

Example 3

Multi-Ply Towel

Base sheets were prepared substantially as described in Example 1 with certain manufacturing parameters adjusted as described in Table 11, below.

TABLE 11

| Sample | Layer Split (Wt. % Air/Middle/Felt) | Refining (hpt/day) | TAD Fabric | Rush Transfer (%) | Base Sheet Basis Weight (gsm) | Base Sheet GMT (g/3") |
|---|---|---|---|---|---|---|
| 11 | 40 EUC/19 NSWK 11 EUC/19 NSWK 11 EUC | 1.8 | T2407-13 | 40 | 29.9 | 2905 |
| 12 | 40 EUC/25 NSWK 5 EUC/25 NSWK 5 EUC | 2.0 | T2407-13 | 40 | 30.7 | 3318 |
| 13 | 40 EUC/25 NSWK 5 EUC/25 NSWK 5 EUC | 2.7 | T2407-13 | 40 | 23.4 | 2556 |

Base sheet was converted to two-ply rolled products by calendering using one or two conventional polyurethane/steel calenders comprising a 4 P&J polyurethane roll on the air side of the sheet and a standard steel roll on the fabric side. Process conditions for each sample are provided in Table 12 and the resulting product properties are summarized in Table 13, below. The calendered base sheet was converted into two-ply rolled tissue products by bringing two tissue webs into facing arrangement with one another and spray laminating to join the webs. The webs were not embossed or subject to other treatments. The rolled products were formed such that Roll 10 comprised two plies of Sample web 10, and so on.

TABLE 12

| Sample | 4 P&J Calender Load (pli) | Product Basis Weight (gsm) | Product Sheet Caliper (μm) | Product Sheet Bulk (cc/g) | Roll Firmness (mm) | Roll Bulk (cc/g) |
|---|---|---|---|---|---|---|
| Roll 11 | 80 | 53.7 | 775.2 | 14.45 | 7.8 | 14.05 |
| Roll 12 | 80 | 54.9 | 768.1 | 13.98 | 8.8 | 13.82 |
| Roll 13 | 80 | 42.0 | 677.2 | 16.12 | 7.7 | 15.19 |

TABLE 13

| Sample | Product GMT (g/3") | Product MD Stretch (%) | Product MD Slope (kg/3") | Product GM Slope (kg/3") | Product MD TEA (g * cm/cm$^2$) | Product Stiffness Index |
|---|---|---|---|---|---|---|
| Roll 11 | 2304 | 24.4 | 8.8 | 9.3 | 47.0 | 4.02 |
| Roll 12 | 2533 | 25.2 | 9.4 | 9.9 | 54.4 | 3.91 |
| Roll 13 | 2043 | 24.6 | 8.3 | 8.2 | 44.6 | 4.00 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A tissue product having a MD TEA (expressed as g*cm/cm$^2$) equal to or greater than about 0.03234(GMT)−27.452 and a GMT from about 2200 to about 3500 g/3", where GMT is the geometric mean tensile expressed in grams per three inches.

2. The tissue product of claim 1 having a percent MD Stretch greater than about 25.

3. The tissue product of claim 1 having a percent MD Stretch from about 40 to about 60.

4. The tissue product of claim 1 having a MD TEA from about 75 to about 100 g*cm/cm$^2$.

5. The tissue product of claim 1 having a geometric mean stretch (GMS) from about 18 to about 22.

6. The tissue product of claim 1 having a MD Slope less than about 10.0 kg/3".

7. The tissue product of claim 1 having a MD Slope from about 3 to about 5 kg/3".

8. The tissue product of claim 1 having a GM Slope from about 4 to about 7.5 kg/3".

9. The tissue product of claim 1 having a Stiffness Index from about 2.0 to about 5.0.

10. The tissue product of claim 9 wherein the at least one through-air dried tissue ply is uncreped.

11. The tissue product of claim 1 having a bone dry basis weight greater than about 50 gsm.

12. The tissue product of claim 1 having a bone dry basis weight from about 50 to about 70 gsm and a sheet bulk from about 15 to about 20 cc/g.

13. The tissue product of claim 1 wherein the product comprises at least one through-air dried tissue ply.

* * * * *